US011408684B1

(12) United States Patent
Richard et al.

(10) Patent No.: US 11,408,684 B1
(45) Date of Patent: Aug. 9, 2022

(54) LOOP HEAT PIPE EVAPORATOR

(71) Applicant: ADVANCED COOLING TECHNOLOGIES, INC., Lancaster, PA (US)

(72) Inventors: Bradley Richard, Coatesville, PA (US); William Anderson, Bound Brook, NJ (US); Richard W. Bonner, III, Lancaster, PA (US); Devin Pellicone, Newtown, PA (US); Chien-Hua Chen, Lititz, PA (US); Greg Hoeschele, Lititz, PA (US); Taylor Maxwell, Lancaster, PA (US); Dan Pounds, Columbia, MO (US); Dan Reist, Mountville, PA (US)

(73) Assignee: Advanced Cooling Technologies, Inc., Lancaster, PA (US)

( * ) Notice: Subject to any disclaimer, the term of this patent is extended or adjusted under 35 U.S.C. 154(b) by 0 days.

(21) Appl. No.: 16/157,841

(22) Filed: Oct. 11, 2018

(51) Int. Cl.
*F28D 15/04* (2006.01)
*F28D 15/02* (2006.01)

(52) U.S. Cl.
CPC ..... *F28D 15/046* (2013.01); *F28D 15/0266* (2013.01); *F28D 15/0283* (2013.01)

(58) Field of Classification Search
CPC ..... F28D 15/046; F28D 15/0266; F28D 15/0283; F28D 15/043
USPC ..... 165/104.26
See application file for complete search history.

(56) References Cited

U.S. PATENT DOCUMENTS

| | | | | |
|---|---|---|---|---|
| 6,227,288 | B1 | 5/2001 | Gluck et al. | |
| 6,241,008 | B1 * | 6/2001 | Dunbar | F28D 15/043 165/104.26 |
| 6,330,907 | B1 * | 12/2001 | Ogushi | F28D 15/043 165/104.26 |
| 6,533,029 | B1 | 3/2003 | Phillips | |
| 7,063,129 | B2 | 6/2006 | Makino et al. | |
| 7,748,436 | B1 * | 7/2010 | Anderson | F28D 15/046 165/104.21 |
| 8,720,530 | B2 * | 5/2014 | Asfia | F28D 15/046 165/104.26 |
| 2004/0024482 | A1 | 2/2004 | White et al. | |
| 2004/0079089 | A1 * | 4/2004 | Wallach | A61M 5/44 62/3.2 |
| 2007/0187072 | A1 * | 8/2007 | Chin | F28D 15/043 165/104.26 |
| 2008/0277099 | A1 * | 11/2008 | Takamatsu | F28D 15/043 165/104.26 |
| 2011/0000646 | A1 * | 1/2011 | Hou | F28D 15/043 165/104.26 |
| 2012/0137718 | A1 * | 6/2012 | Uchida | F28D 15/043 62/259.2 |
| 2013/0206369 | A1 | 8/2013 | Lin et al. | |
| 2014/0190667 | A1 | 7/2014 | McGlen et al. | |
| 2014/0345832 | A1 | 11/2014 | Lin et al. | |
| 2015/0306667 | A1 | 10/2015 | Yao | |

(Continued)

FOREIGN PATENT DOCUMENTS

JP 4627212 B2 2/2011

*Primary Examiner* — Tho V Duong
(74) *Attorney, Agent, or Firm* — McNees Wallace & Nurick

(57) ABSTRACT

A loop heat pipe evaporator includes a porous primary wick, and a nonporous envelope unseparatingly surrounding the primary wick. The primary wick and the envelope are of one-piece construction.

27 Claims, 8 Drawing Sheets

(56) References Cited

U.S. PATENT DOCUMENTS

| | | | | |
|---|---|---|---|---|
| 2017/0064868 | A1 | 3/2017 | Rush et al. | |
| 2017/0363363 | A1 | 12/2017 | Lassini et al. | |
| 2017/0363373 | A1 | 12/2017 | Cai et al. | |
| 2018/0031330 | A1* | 2/2018 | Roberts | F28D 15/046 |

* cited by examiner

LOOP HEAT PIPE EVAPORATOR

STATEMENT REGARDING FEDERALLY SPONSORED RESEARCH

This invention was made with government support under contract number NNX16CM46P awarded by the National Aeronautics and Space Administration. The government has certain rights in the invention.

FIELD OF THE INVENTION

The present invention is directed to loop heat pipes.

BACKGROUND OF THE INVENTION

Loop heat pipes (LHPs) are a key element in many aerospace related thermal management systems, and the heart of an LHP system is a capillary pump. The capillary pump is a passive pump which circulates a working fluid in a closed loop system in order to efficiently transfer high heat loads over long distances, and especially when subjected to harsh environmental conditions. Typically, the capillary pump or pump assembly is manufactured using a legacy technique that is cumbersome, labor intensive, and suffers from an unacceptably low yield rate. Because the pump assembly is the heart of the LHP system, the wick in situ characteristics are highly indicative of the system's overall thermal performance. Imperfections in the pump assembly construct are primarily a product of the manufacturing process's overall complexity and the choice of materials. Specifically, the primary wick's hydrodynamic characteristics and sealing integrity to an enclosure or envelope are critical to heat transport, start-up, shut down, and overall reliability. It is estimated that the cost to produce a pump assembly that has been deemed acceptable, including the attachment of a bayonet, secondary wick, and compensation chamber, accounts for approximately 75% of the total system's manufacturing cost.

LHPs are high thermal conductance devices that are self-contained and passive. FIG. 1 shows a schematic of a conventional LHP 10. Heat 11 enters an evaporator 12 and vaporizes a working fluid at an outer surface of wick 14. The vapor is collected by a system of circumferential grooves 16, axial grooves 17, and header 20 as collectively shown in FIGS. 2-4. As further shown in FIG. 1, vapor flow 18 in a vapor line 22 is received by a condenser 24 where the vapor condenses as heat 13 is removed by a cold plate 26. Most of condenser 24 is filled with a two-phase mixture. A small section at the end of condenser 24 provides a small amount of sub-cooling.

As further shown in FIG. 1, a compensation chamber 28, sometimes referred to as a reservoir at an end of evaporator 12 is designed to operate at a lower temperature than evaporator 12 (and condenser 24). Since the temperature is lower, the pressure of the saturated fluid in compensation chamber is also lower. This lower pressure forces condensate through condenser 24 and liquid return line 30. Fluid flow 32 from liquid return line 30 is received in a central pipe where it feeds wick 14. Excess fluid drains into compensation chamber 28. As shown in FIG. 3, a secondary wick 34 in evaporator 12 and extending into compensation chamber 28 allows the liquid in the compensation chamber to feed evaporator wick 14.

The liquid in compensation chamber 28 and the interior of wick 14 must be returned to the exterior surface of the wick to close the cycle. Capillary forces accomplish this passively, drawing liquid back to the surface, just as water will be drawn up into a sponge. Loop heat pipes are made self-priming by carefully configuring and controlling fluid volumes relative to the compensation chamber 28, condenser 24, vapor line 22, and liquid return line 30, so that liquid is always available to wick 14. Compensation chamber 28 and fluid charge are set so that there is always fluid in the compensation chamber 28 even if the condenser 24, vapor line 22, and liquid return line 30 are completely filled. The LHP is thus inherently self-priming.

A conventional LHP wick 14 is shown in FIG. 5. Heat is applied to the area with threaded circumferential grooves 16 and axial grooves 17. These grooves 16, 17 form what is known as an inverted wick. Most of the evaporator surface is bare. Heat must conduct to the tips of the wick 14 (i.e., the top of the "screw threads" of circumferential grooves 16). This is extremely inefficient, since less than the entire evaporator surface is available for evaporation, i.e., only where the tops of the threaded grooves 16 of wick 14 are located.

Key components of the Loop Heat Pipe system include the pump assembly and its corresponding subcomponents. Key subcomponents of the pump assembly include a cylindrical evaporator body or envelope, a primary wick, a secondary wick, a bayonet, two bi-metallic transition couplings, and a Knife Edge Seal (KES). The compensation chamber is welded to this pump subassembly via one of the bimetallic transitions. The KES is critical for developing the differential pressure required to drive the working fluid around the system. The material selection and installation mechanics for these components are critical to the device's operation for a number of reasons; high sensitivity to heat leak, KES effectiveness, and sensitivity to the thermal resistance through the envelope. The material selection required to satisfy these objectives is a large source of the shortcomings associated with its production.

Traditionally, the primary wick of the capillary pump is produced externally from the envelope itself in a multi-step manufacturing process. For comparison purposes, the process is described in a simplistic form as follows:

1) Powder forming the primary wick structure is compressed and loaded in a sintering mandrel.
2) The sintering mandrel is soaked under a controlled atmosphere at high temperatures in order to sinter the powder particles together.
3) The primary wick is visually inspected for cracking and the pore size is characterized.
4) The primary wick is machined to its final dimensions, and then vapor grooves and the bayonet insertion hole are machined into the porous structure of the primary wick.
5) The primary wick is again inspected for cracking, dimensional conformity, and pore size.
6) To achieve an interference fit, the envelope is heated to a high temperature to expand the bore diameter, and then the primary wick is inserted. The envelope is allowed to cool and contract around the primary wick.
7) The primary wick is inspected in situ for cracking and pore size.
8) The knife edge seal is installed, along with the bimetallic couplings and remaining assembly components (bayonet, secondary wick, compensation chamber)

Currently, the primary wick is produced external from the envelope, typically using sintered nickel powder. The fabrication process entails compacting nickel powder into a sintering mandrel and firing at high temperatures. The oversize wick is then machined at low speeds, and without lubricant to produce the vapor grooves and reduce the outer diameter to the proper size.

Once the primary wick is successfully produced, machined to the correct size, and hydrodynamically characterized, then the insertion process takes place. With a slight interference fit between the primary wick and the envelope, the envelope is heated to expand its inner diameter. The primary wick is then chilled to slightly reduce its diameter and inserted inside of the envelope. The design of the primary wick and the interference fit theoretically results in intimate contact between all the circumferential grooves of the primary wick and the aluminum envelope. In practice, once the primary wick is installed, the actual contact area between the primary wick and the envelope is unknown. It is believed that the physical insertion of the primary wick shaves and smears the circumferential grooves of the primary wick, thereby reducing contact and subsequently the thermal performance of the assembly. Due to the level of precision required to successfully insert a primary wick, the risk of damaging the primary wick or not achieving the proper placement is relatively high. Historical yield rates for the insertion process are estimated at less than 50 percent.

Once the primary wick is inserted into the envelope, the Knife Edge Seal 38 must be installed, such as schematically depicted in FIG. 6. A bi-metallic insertion piece with the knife edge features is evenly pressed into the sintered primary wick, creating a seal between the inner and outer regions of the primary wick. A bi-metallic interface is necessary because it is desirable to have a KES material with a higher hardness than compared to the aluminum LHP envelope in order to maintain the knife edge's sealing integrity. Experience has shown that a proper seal is not always achieved, and if this KES insertion process fails and reinsertion is attempted, the primary wick is likely to become damaged. This damage typically requires the primary wick to be scrapped. The envelope may be reused but a new primary wick much be manufactured. It is also possible for the KES to pass verification testing after assembly but fail later after numerous thermal cycles or vibration testing.

Once the bayonet and secondary wick subassembly are inserted into the bore of the primary wick, the next step in the LHP pump assembly is attaching the front end of the compensation chamber by welding to the bimetallic. This process is of concern, due to mismatches in the material coefficient of thermal expansion in the aluminum-stainless steel bimetallic transition coupling. Excessive heating of the bimetallic coupling causes the materials to expand at different rates resulting in a significant stress at the two-material interface. The bimetallic coupling is an off-the-shelf component, and that interface is typically produced using a friction-stir welding process that has historically been shown to produce an excellent bond between dissimilar metals. However, excessive heating of this component has an inherent high level of risk and has resulted in part failure.

The final step is to install the secondary wick and bayonet, and then finish assembly of the compensation chamber. The bayonet and secondary wick distribute the liquid returning from the condenser along the primary wick. In addition, the secondary wick draws liquid by capillary action from the compensation chamber as needed, particularly during sudden changes in power. The secondary wick is made in two parts. One part is sintered around the bayonet tube. It is fabricated from sintered screen, and has small passages to vent any vapor from the bayonet. In addition, the compensation chamber has a series of screen webs to collect liquid during micro-gravity operation, and deliver it to the wick around the bayonet.

Since the vapor grooves are machined into the primary wick and the envelope is a smooth bore, there is an absence of porous wick material on the inside surface of the envelope. This may lead to an increase in overall thermal resistance, compared to an envelope having wick material lining the portions of the inside surface corresponding to the vapor groove locations of the primary wick. The vapor groove locations are the primary heat input region of the device. Since the conventional designs do not have a porous wick structure attached to the inside surface of the heat input region, heat must first conduct radially to a contact point of the primary wick structure and then into the relatively low thermal conductivity wick structure to the evaporation sites.

In summary, major challenges in LHP fabrication which lead to high cost manufacturing techniques are listed below:

1) Making small vapor grooves with extremely tight tolerances on the primary wick.
2) Maintaining good thermal contact between the evaporator envelope and primary wick without damaging the vapor grooves.
3) Sealing the surface between the primary wick and evaporator envelope to prevent leaking between the evaporator and compensation chamber.
4) Achieving reliable joints between dissimilar materials.
5) The secondary wick is sintered separately, machined, and then inserted into the primary wick.

FIG. 7 shows a cross section of a conventional secondary wick 34. Secondary wick 34 provides a hydraulic link between the fluid in the compensation chamber 28 (FIG. 1) and the fluid in the evaporator 12 (FIG. 1). Secondary wick 34 ensures that primary wick 14 remains wetted during transients when there may be an imbalance between the liquid returning from condenser 24 (FIG. 1) and fluid being evaporated at the primary wick. Secondary wick 34 contains axial vapor grooves 35 to allow vapor to flow between compensation chamber 28 (FIG. 1) and primary wick 14, secondary wick 34 having larger pores than primary wick 14 in order to reduce pressure drop. Secondary wick 34 is typically fabricated using metal screen which is wrapped around bayonet tube 36.

Conventionally, as shown in FIG. 3, primary wick 14 is sintered and then machined to add the vapor grooves 16, 17 and a blind opening 42 for secondary wick 34 and bayonet tube 36 (FIG. 7) insertion. This is currently a major cost driver. An oversized primary wick 14 must be fabricated then be machined to very tight tolerances, on the order of 0.001 inch. The machining must be done without the use of machining fluids to prevent contamination of primary wick 14. Without machining fluids, the machining process must be performed at extremely low speeds. After machining, primary wick 14 is inserted into an evaporator envelope 40 (FIG. 7). Extremely tight tolerances are required to achieve good thermal contact between primary wick 14 and envelope 40 (FIG. 7), making wick insertion a delicate process which can cause damage to vapor grooves 16, 17 formed in primary wick 14. Next a knife edge seal 38 (FIG. 6) is used to seal the surface between primary wick 14 and evaporator envelope 40 (FIG. 7) to prevent leaking between evaporator 12 and compensation chamber 28. Forming the knife edge seal 38 (FIG. 6) is a high risk process resulting in wasted materials when failure occurs. Also, the knife edge seal 38 is made using a material with a higher hardness than aluminum which creates the need for a bimetallic transition joint. Using dissimilar metals reduces the reliability of the part, since the bimetallic steel/aluminum joint is made by friction welding, with a very low strength.

Loop heat pipes that do not suffer from one or more of the above drawbacks would be desirable in the art.

SUMMARY OF THE INVENTION

In an exemplary embodiment, a loop heat pipe evaporator includes a porous primary wick and a nonporous envelope unseparatingly surrounding the primary wick. The primary wick and the envelope are of one-piece construction.

In a further exemplary embodiment, a loop heat pipe evaporator includes a porous primary wick, and a nonporous envelope unseparatingly partially surrounding the primary wick. The primary wick and the envelope are of one-piece construction. The loop heat pipe evaporator has a non-circular cross section.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 8A is a partial cross section of an exemplary primary wick and evaporator envelope.

Wherever possible, the same reference numbers will be used throughout the drawings to represent the same parts.

DETAILED DESCRIPTION OF THE INVENTION

With the use of Direct Metal Laser Sintering (DMLS), otherwise known as 3D printing, LHP evaporators, or at the least portions or multiple components of LHP evaporators can be fabricated as a single part or of one-piece construction. The primary wick is produced with vapor passageways, a slot for secondary wick and bayonet tube insertion, and an integrated envelope with weld joints for direct attachment to the compensation chamber and vapor line end cap. This results in the following benefits:

1) Machining of the vapor "passageways" (versus grooves) is not required since they can be incorporated through the DMLS process.
2) The primary wick and evaporator envelope are integrated into a single part or of one-piece construction, creating good thermal contact between them and eliminating the hot insertion step.
3) The evaporator envelope creates the seal between the evaporator and compensation chamber, eliminating the need for the knife edge seal.
4) The entire assembly can be made using the same one material, such as stainless steel, nickel, aluminum, or titanium, eliminating the need for a bimetallic joint.
5) The secondary wick and the bayonet can be 3D printed at the same time.
6) The circumferential and axial passageways do not need to be located directly against the interior wall of the evaporator envelope. Instead, a small amount of wick can be added between the passageways and the interior wall. This improves performance, since the liquid is more readily available at the heated surface.

Figure 1:
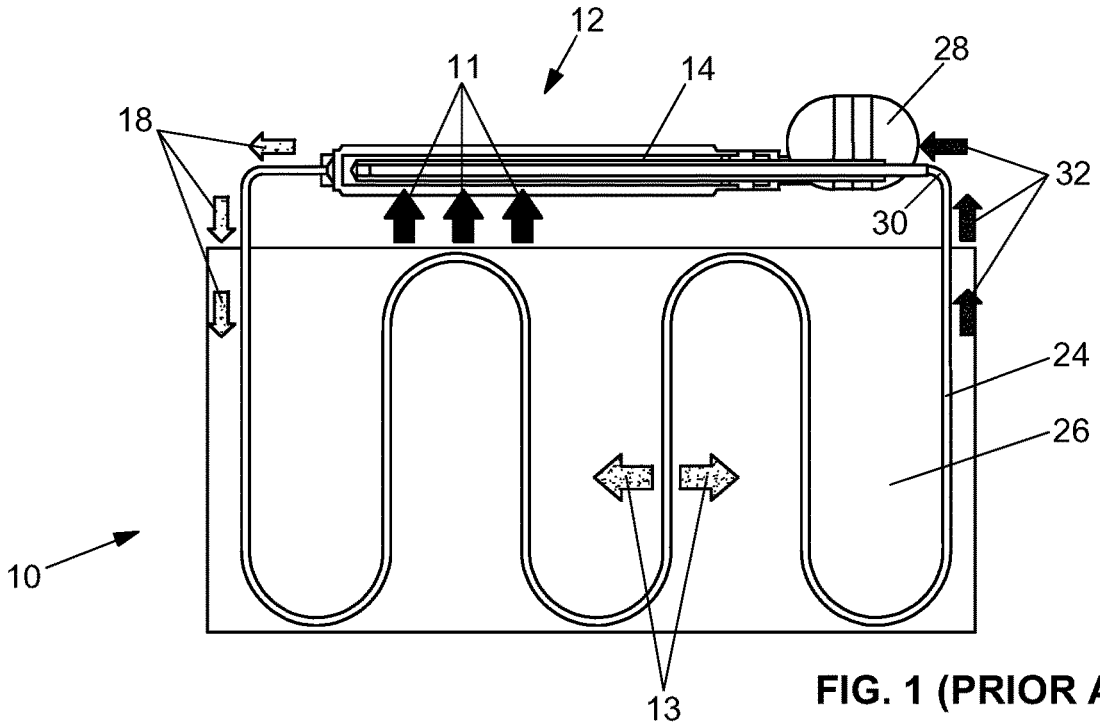
FIG. 1 (PRIOR ART)
FIG. 1 is a schematic view of a conventional loop heat pipe.
Figure 3:
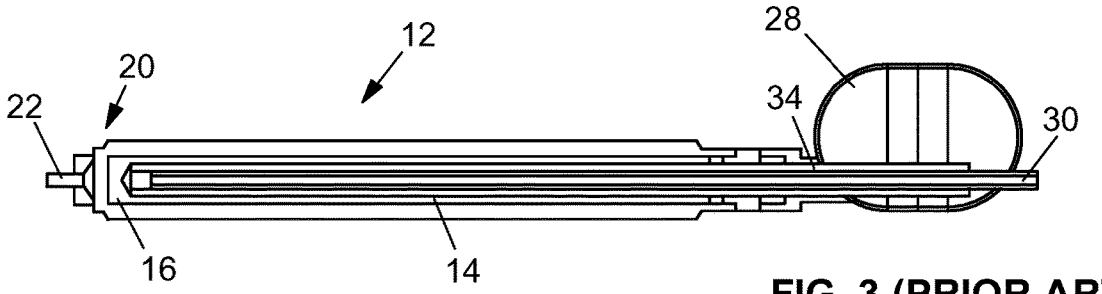
FIG. 3 (PRIOR ART)
FIG. 3 an enlarged, partial cross section of the loop heat pipe of FIG. 1.
Figure 2:
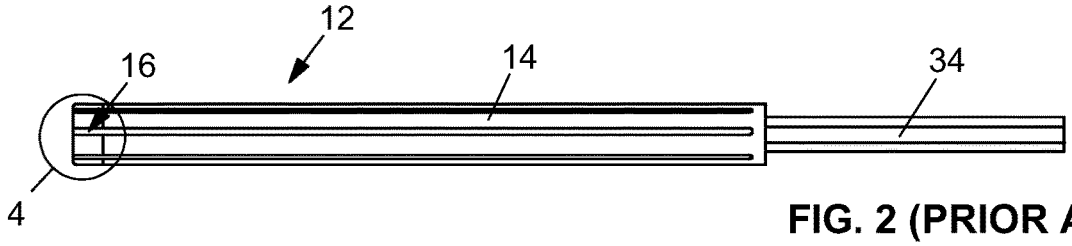
FIG. 2 (PRIOR ART)
FIG. 2 is a schematic view of a conventional evaporator of the loop heat pipe of FIG. 1.
Figure 4:
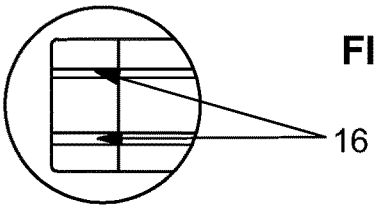
FIG. 4 (PRIOR ART)
FIG. 4 is an enlarged view of a cross section taken from region 4 of FIG. 2.
Figure 5:
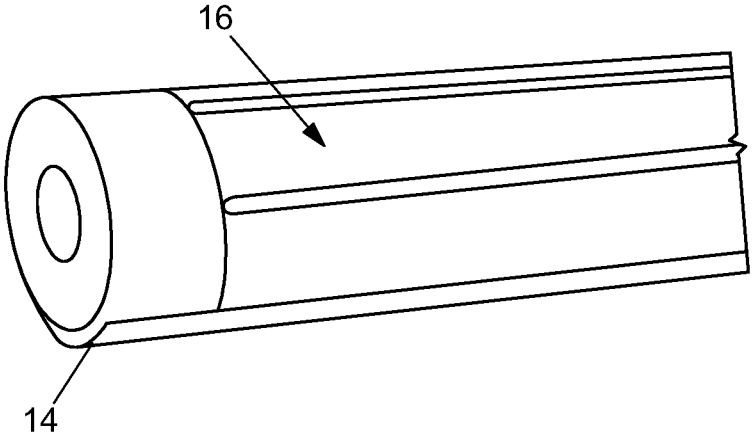
FIG. 5 (PRIOR ART)
FIG. 5 is a partial upper perspective view of a conventional primary wick.
Figure 6:
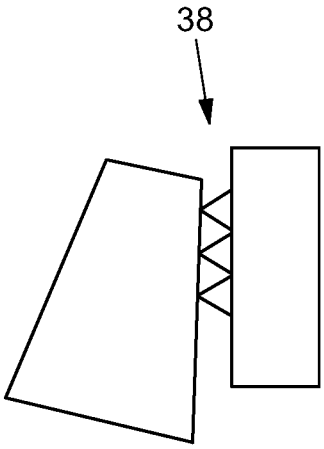
FIG. 6 (PRIOR ART)
FIG. 6 is a schematic view of a conventional knife edge seal.
Figure 8:
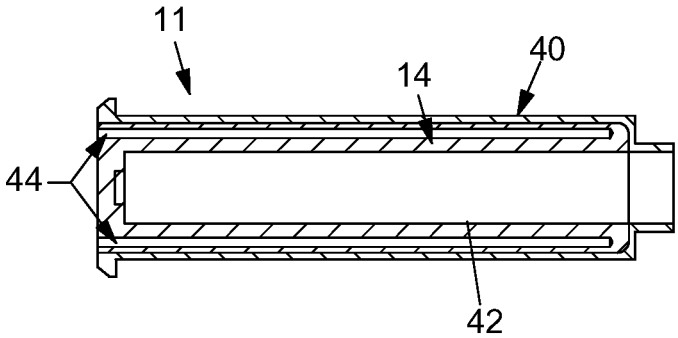
FIG. 8 is a cross section of an exemplary primary wick and evaporator envelope.
Figure 10:
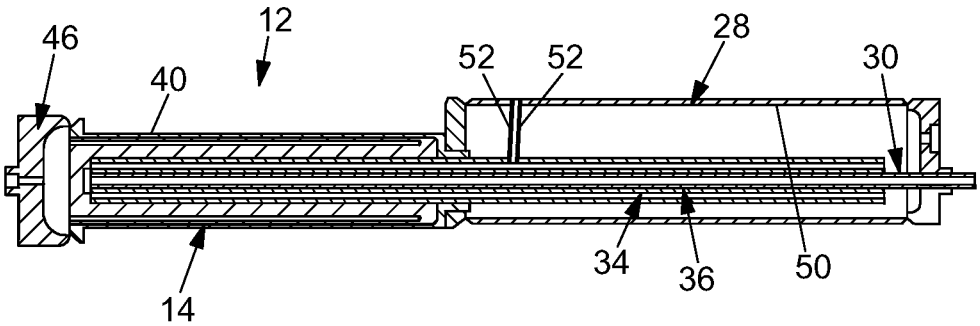
FIG. 10 is a cross section of an exemplary evaporator and compensation chamber.
Figure 11:
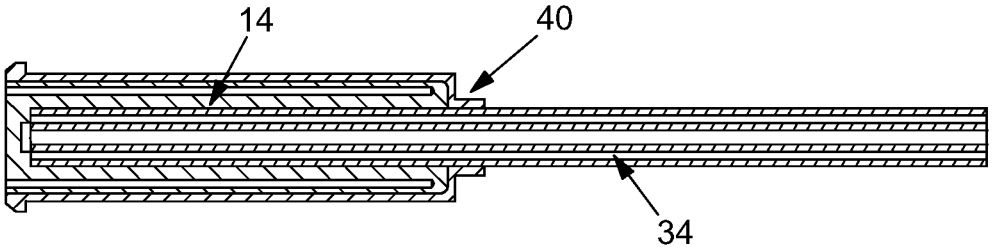
FIG. 11 is a cross section of an exemplary evaporator.

A cross section of an exemplary primary wick 14 with integrated envelope 40 is shown in FIG. 8. That is, nonporous envelope 40 unseparatingly surrounds porous primary wick 14 forming a unitary or one-piece construction. Primary wick 14 includes a blind opening 42 for receiving secondary wick 34 (FIG. 10) and bayonet tube 36 (FIG. 10). With secondary wick 34 (FIG. 10) and bayonet tube 36 (FIG. 10) installed, liquid enters through the bayonet tube 36 (FIG. 10) and is transported to a plurality of vapor passageways 44 via capillary forces in the porous structure. Vapor passageways 44 are positioned along a periphery of primary wick 14 in close proximity to envelope 40. Heat 11 enters primary wick 14 through contact with the fully dense or nonporous enclosure or envelope 40 and evaporates the liquid at the walls of the vapor passageways 44. The vapor travels through passageways 44 out of primary wick 14 and into the vapor line 22 (FIG. 1). By using DMLS to fabricate primary wick 14, the porous core and nonporous enclosure 40 can be made as a single part or one-piece construction in one step. Conventional methods of fabrication require machining of the porous wick and insertion into an enclosure. This creates the need for a knife-edge seal to prevent backflow of vapor from the evaporator to the compensation chamber, as previously discussed. Also, the vapor passageways made using DMLS can have much larger length to diameter ratios than grooves made using conventional machining processes. In one embodiment, the vapor passageways have a length to diameter ratio of greater than 3:1.

Furthermore, as a result of using DMLS to fabricate primary wick 14, passageways 44 may be formed internally or slightly recessed relative to its peripheral surface. For example, one or more of passageways 44 may be positioned along the periphery of primary wick 14 a predetermined distance away from envelope 40, such as at least 0.005 inch. In one embodiment, the predetermined distance of at least one passageway 44 away from envelope 40 may vary along any portion of its length. This arrangement permits the entire surface area of primary wick 14 to be in contact with envelope 40, providing increased operational efficiencies.

As a result of using DMLS to fabricate primary wick 14, passageways 44 may be formed in any number of geometries. In one embodiment, one or more passageways 44 may have a noncircular geometry. In one embodiment, passageways 44 may have a cross-sectional area different from one or more other passageways. In one embodiment, a cross-sectional area of passageways 44 may increase based on a distance from a vapor line. In one embodiment, one or more of passageways 44 may branch or bifurcate to form bifurcated passageways 45 (FIG. 8A) near a vapor line.

For purposes herein, the term "unseparatingly surrounds", "separatingly surrounding" and the like is intended to mean that there is an intimate bond between the surface of the surrounding component and the facing or corresponding surface of the surrounded component, such as the inside surface of the envelope, and the outside surface of the primary wick. That is, the inside surface of the envelope is metallurgically bonded to the outside surface of the primary wick.

For purposes herein, the term "surrounding" and the like is intended to include "unseparating surrounding", as previously discussed, but is not so limiting. That is, for example, the inside surface of the envelope is not necessarily metallurgically bonded to the outside surface of the primary wick, and intended to include an arrangement where the envelope in the primary wick are separate components that are assembled together.

For purposes herein, the term "nonporous" and the like is intended to mean essentially impervious to fluid flow or leakage. For example, an intact exterior surface of the envelope does not permit fluid flow of fluid from an interior surface of the envelope through the exterior surface, such as by capillary action.

For purposes herein, an LHP pump 64 (FIG. 10) is composed of LHP evaporator 12, secondary wick 34, and compensation chamber 28.

Figure 7:
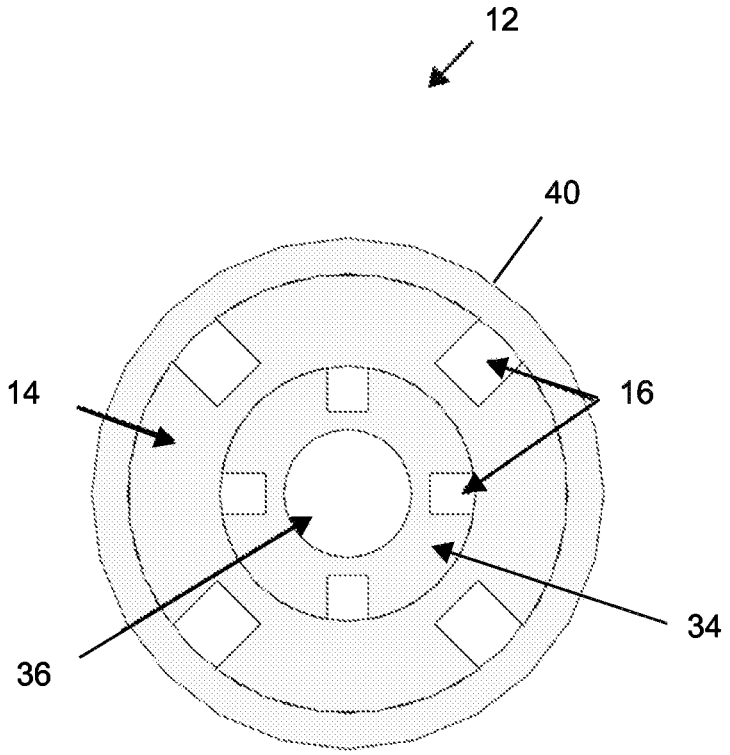
FIG. 7 (PRIOR ART)
FIG. 7 is an end view of a conventional evaporator.
Figure 9:
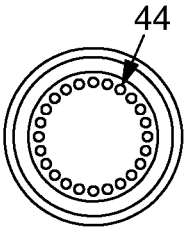
FIG. 9 is an end view of the primary wick and evaporator envelope of FIG. 8.

A cross section of an LHP evaporator 12 with 3D printed primary wick 14 and envelope 40 is shown in FIG. 10. Secondary wick 34 is surrounded by blind opening 42 (FIG. 8) of primary wick 14 that is connected to compensation chamber 28. Secondary wick 34 extends past primary wick 14 into compensation chamber 28. A nonporous structure 46, such as a vapor line end cap is sealingly secured such as by welding directly onto the envelope 40 at one end of primary wick 14, and another nonporous structure 48, such as a compensation chamber adapter is sealingly secured such as by welding directly onto the envelope 40 at an opposite end of primary wick 14, thereby preventing fluid leakage between passageways 44 at a first pressure, and compensation chamber 28 at a second pressure, the first pressure being greater than the second pressure. This novel arrangement eliminates the knife-edge seal and bimetallic joints which are currently used to connect primary wick 14 and compensation chamber 28. Secondary wick 34 can be inserted into primary wick 14 or printed with primary wick 14 as a single part to reduce the number of fabrication steps for faster production. Secondary wick 34 surrounds a nonporous tube, such as a bayonet tube 36 (FIG. 7) extending past secondary wick 34 and into compensation chamber 28, wherein the tube is centrally positioned in the LHP. In one embodiment, secondary wick 34 comprises a plurality of vapor passageways 44 (FIG. 8) positioned near bayonet tube 36 (FIG. 7).

Figure 12:
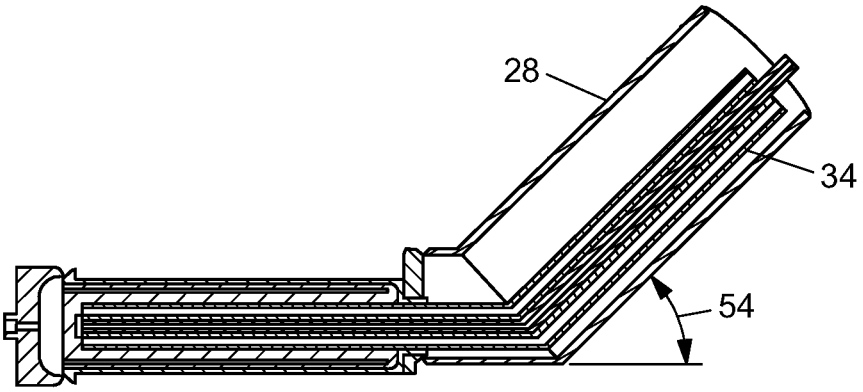
FIG. 12 is a cross section of an exemplary evaporator and compensation chamber.

Additionally, secondary wick 34 may also be fabricated along with primary wick 14 and evaporator envelope 40 as one single part or one-piece construction as shown in FIG. 10. In one embodiment, primary wick 14, secondary wick 34, envelope 40, and compensation chamber 28 may be fabricated as one single part or one-piece construction. The evaporator envelope 40 is fully dense or nonporous to prevent leaking and has weld joints as described above. Primary wick 14 has a fine pore radius of less than 10 μm to provide sufficient capillary pressure to operate the LHP. In one embodiment, the pore size (defined here as twice the pore radius) of primary wick 14 is between about 0.5 μm to about 2 μm. Secondary wick 34 is fabricated radially inward from primary wick 14, and extends past the primary wick 14 into compensation chamber 28. The pore radius of secondary wick 34 is more coarse than the primary wick 14 (>20 μm). Secondary wick 34 and primary wick 14 are in contact allowing the working fluid to be transported between them with minimal pressure drop. It is to be understood that all or any portion of the parts shown in FIG. 10 may be 3D printed at the same time. Compensation chamber 28 may also have a porous layer 50 such as a series of screen wicks running around are located on an interior surface, with a plurality of wicks 52 or wick webs extending to secondary wick 34. These wicks 52 can also be 3D printed in the same operation. Also, secondary wick 34 and compensation chamber 28 can be printed to incorporate a geometry subtending an acute angle 54, such as between about 5 degrees and 90 degrees as shown in FIG. 12. This ensures that during ground operations secondary wick 34 is always submerged in liquid even if the LHP is tilted for mobile applications.

It is to be understood that any one of or all of any of the entire LHP assembly, including the envelope, the primary wick, the secondary wick, and the compensation chamber may be constructed of one material, such as stainless steel, nickel, aluminum, or titanium. In one embodiment, any one of these components may be constructed with different materials.

Figure 13:
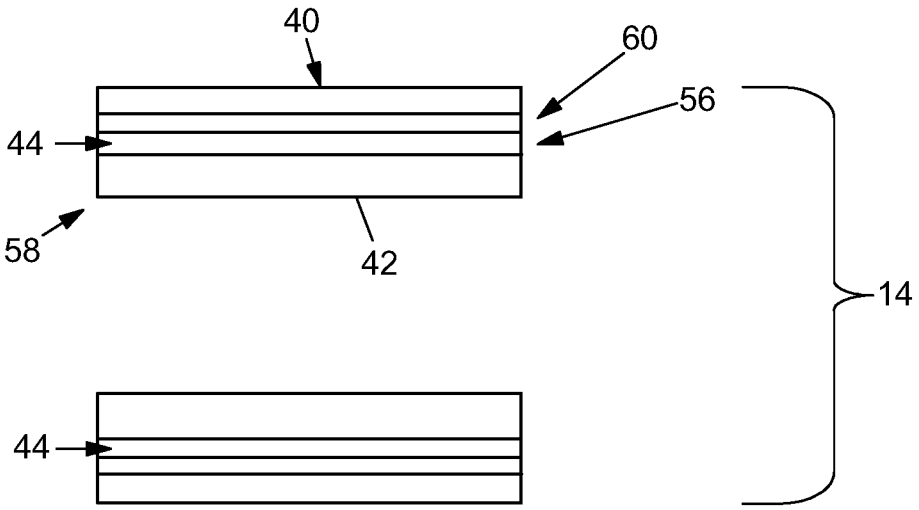
FIG. 13 is an enlarged, partial cross section of an exemplary evaporator.

Conventional primary wicks 14 have a uniform pore size throughout. Since this pore size is typically around 1 μm, the wick permeability is low, and the pressure drop through the wick is high. A pressure drop at a given power level of the system can be reduced, and the performance improved, by using a graded primary wick 14, such as shown in FIG. 13, in which a property of the primary wick varies based on a distance from vapor passageways 44, such as the pore radius or pore size. Stated another way, the pore radius or pore size may vary based on a distance between its outer surface and its inner surface. In one embodiment, a property of the primary wick may also vary along its length. In other words, in a graded primary wick 14, the pore radius or pore size is not constant throughout. For example, as shown in FIG. 13, graded primary wick 14 comprises a pore size region 56 having a small pore size and surrounding vapor passageways 44. Graded primary wick 14 further comprises an additional pore size region 58 unseparatingly surrounded by pore size region 56, pore size region 58 gradually becoming coarser, i.e., pore size increasing based on an increasing distance from vapor passageways 44, or stated another way, as a result of a decreasing radial distance from secondary wick 34, or stated another way, as a result of an increasing inward direction away from pore size region 56.

In one embodiment, pore size region 56 has a pore size between about 0.5 μm and about 10 μm, and pore size region 58 has a pore size of greater than 10 μm. In one embodiment, pore size region 56 may vary based on an increasing distance from vapor passageways 44, or other reason, such as based on a distance from compensation chamber 28 (FIG. 12). In one embodiment, graded primary wick 14 may incorporate more than two pore size regions. For example, a pore size region 60 may be positioned between envelope 40 and passageways 44. In one embodiment, pore size region 60 may have a pore size of greater than 10 μm, and unseparatingly surrounding a corresponding pore size region surrounding passageways 44, the corresponding pore size region having a pore size of about 1 μm, in which in one embodiment, at least a portion of passageways 44 are positioned in fluid communication with the corresponding pore size region in close proximity to envelope 40 and pore size region 60. In one embodiment, any of the pore size regions may have a constant pore radius or pore size throughout. In one embodiment, any of the pore size regions may be graded. A cross section of this design is shown in FIG. 13. This design allows for maximum capillary pumping power without increasing the pressure drop through the wick itself. As discussed above, the even coarser secondary wick 34 can be fabricated in the same process.

In one embodiment, secondary wick 34 may contain one or more pore size regions, similar to primary wick 14. It is to be understood that secondary wick 34 may contain similar embodiments as previously discussed for primary wick 14.

The term "outer surface", "outside surface" and the like such as in the context of primary wick 14 is intended to refer to the outer or outside extent of primary wick 14, such as with primary wick 14 and envelope 40 being of one-piece construction.

Figure 14:
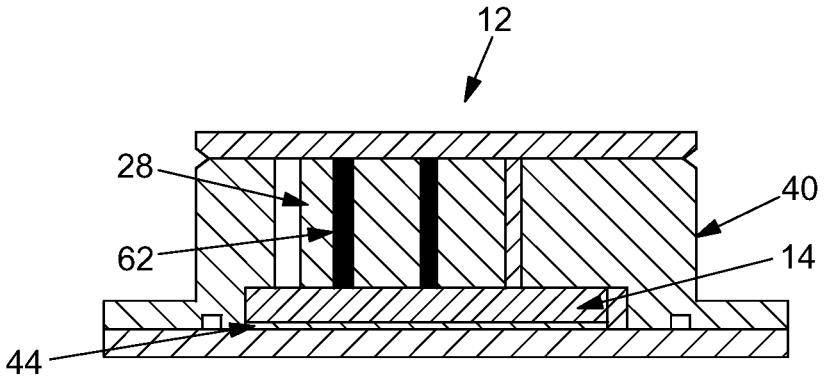
FIG. 14 is a cross section of an exemplary evaporator and compensation chamber.

Alternative LHP primary wick 14 geometries may also be fabricated with an integrated or one-piece construction of envelope 40 and compensation chamber 28. For example, a non-circular cross section, such as a flat, generally rectangular cross section of an LHP evaporator 12 is shown in FIG. 14. In one embodiment, envelope 40 partially unseparatingly surrounds primary wick 14, with passageways 44 facing a substrate 64 secured to envelope 40. In one embodiment, a substrate 66 opposite substrate 64 is secured to envelope 40. In one embodiment, substrates 64, 66 are generally parallel to one another. Using an integrated envelope 40 and primary wick 14 or one-piece construction eliminates the thermal contact resistance present in traditional designs where the wick and envelope are fabricated separately and compressed together. This design also includes compensation chamber 28 having internal integrated support structures 62. The support structures 62 provide structural rigidity and strength, permitting system operation across a large pressure range. This LHP geometry can also benefit from a graded primary wick 14. In this configuration the primary wick would have a fine wick (<10 μm) at the base where the vapor passageways are located. The pore size and therefore permeability of the wick would increase moving towards the reservoir to reduce pressure drop without any losses in capillary pressure at the vapor/liquid interface.

Examples

Figure 15:
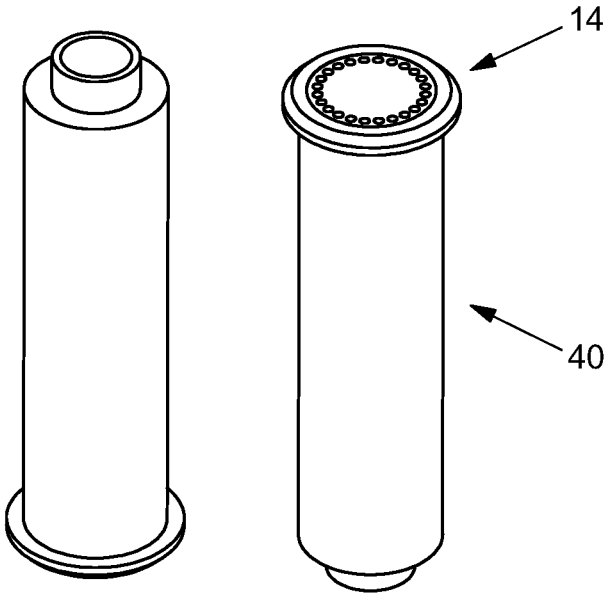
FIG. 15 is an upper perspective view of reversed orientations of an exemplary primary wick and evaporator envelope.
Figure 16:
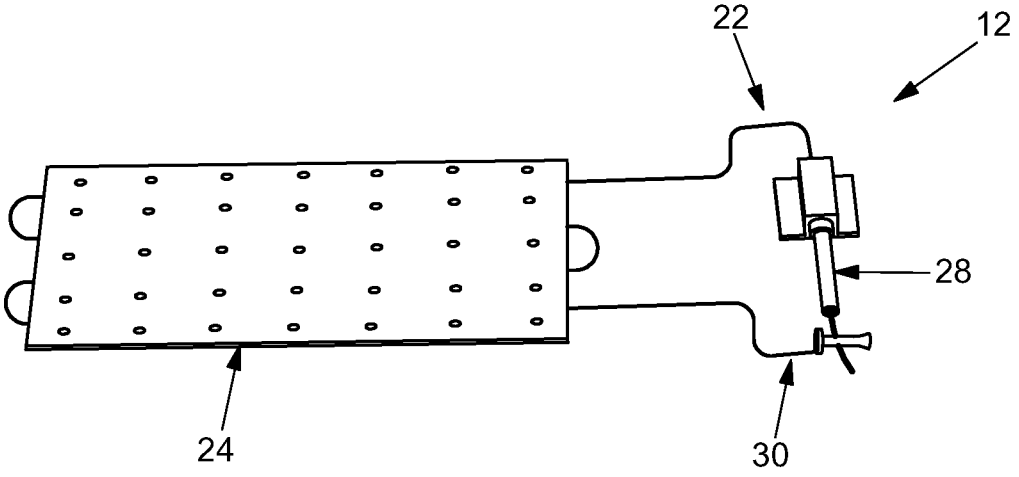
FIG. 16 is an upper perspective view of an exemplary loop heat pipe.

Stainless steel primary wicks 14 with integrated evaporator envelopes 40 were fabricated as shown in FIG. 15. The envelope was helium leak checked and had a leak rate less than 5×10-9 std cc/s, satisfying a requirement for aerospace applications. A complete LHP prototype was then built as shown in FIG. 16. The evaporator and condenser sections were joined together with a Swagelok® fitting which was welded onto the ⅛ in. condenser line tubing. The condenser tubing length is 3.2 m to replicate the length required on a deployable radiator. The entire LHP was helium leak checked and had a leak rate less than 5×10-9 std cc/s. The entire LHP assembly was proof pressure tested with methanol up to 600 psi which is twice the pressure of ammonia at the maximum operating temperature of 50° C. The methanol was then baked out and the LHP was charged with ammonia.

Figure 17:
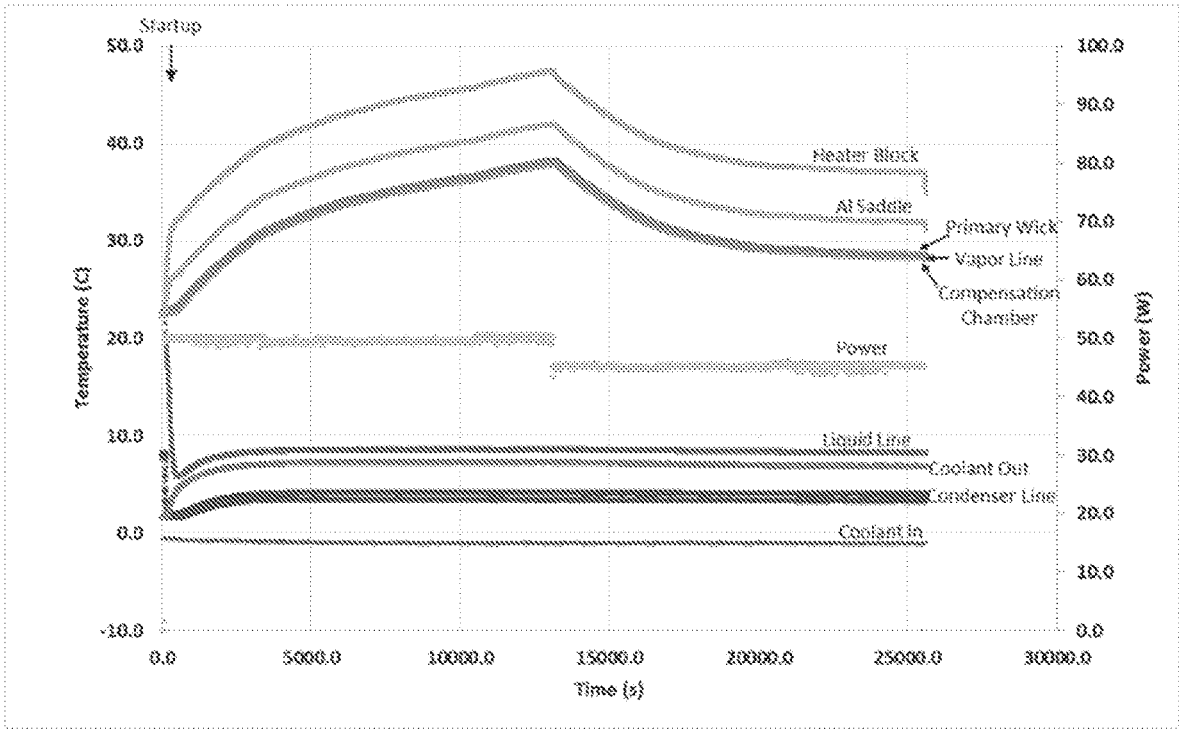
FIG. 17 is a graphical depiction of test results of the loop heat pipe of FIG. 16.

A plot of the prototype testing results with ammonia as the working fluid is presented in FIG. 17. For startup a power of 50 W was applied to the heater block (not shown in FIG. 16). Startup was almost immediate which is evidenced by the drop in the liquid line temperature from ambient temperature (22° C.) to about 8° C. The drop in liquid line temperature shows that fluid is being pumped through the condenser 24 (FIG. 16) and subcooled. The temperature of the evaporator 12 (FIG. 16) continued to increase at a power of 50 W and did not level off. Once the evaporator temperature approached the safety shutoff temperature, the power was reduced to 45 W. At 45 W the evaporator temperatures lowered and approached a steady state value. A maximum operating power of 45 W is within 20% of the expected value of 55 W based on a pressure drop model.

The aspects and embodiments of the invention can be used alone or in combinations with each other.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A loop heat pipe, comprising:

a porous primary wick;

a secondary wick surrounded by the primary wick;

a compensation chamber;

wherein the secondary wick connects the primary wick and the compensation chamber, and the secondary wick extends past the primary wick into the compensation chamber; and a nonporous envelope unseparatingly surrounding the primary wick;

wherein the primary wick includes a plurality of vapor passageways formed internally therein, wherein the plurality of vapor passageways is positioned along a periphery at least 0.005 inch away from the envelope, and wherein the primary wick and the envelope are of one-piece construction.

2. The loop heat pipe of claim 1, wherein a property of the primary wick varies based on a distance from a plurality of vapor passageways.

3. The loop heat pipe of claim 2, wherein the varying property of the primary wick is pore size.

4. The loop heat pipe of claim 3, wherein the primary wick comprises a first pore size region surrounding the plurality of vapor passageways; and a second pore size region surrounded by the first pore size region, wherein a pore size of the second pore size region is greater than a pore size of the first pore size region.

5. The loop heat pipe of claim 4 further comprises a bayonet tube surrounded by the secondary wick;

wherein the pore size of the second pore size region and the secondary wick increasing in an increasing inward direction away from the first pore size region.

6. The loop heat pipe of claim 5, wherein the first pore size region has a pore size of about 1 μm.

7. The loop heat pipe of claim 5, wherein the first pore size region has a pore size between about 0.5 μm and about 10 μm, and the second pore size region has a pore size of greater than 10 μm.

8. The loop heat pipe of claim 1, wherein the primary wick further comprises a third pore size region positioned between the envelope and the plurality of vapor passageways, the third pore size region having a pore size of greater than 10 μm; and a fourth pore size region unseparatingly surrounded by the third pore size region, the fourth pore size region surrounding the plurality of vapor passageways, the fourth pore size region having a pore size of about 1 μm.

9. The loop heat pipe of claim 8, wherein at least a portion of the plurality of vapor passageways are positioned in fluid communication with the third pore size region in close proximity to the envelope and the fourth pore size region.

10. The loop heat pipe of claim 8, wherein the primary wick further comprises a fifth pore size region surrounded by the plurality of vapor passageways of the fourth pore size region, a pore size of the fifth pore size region increasing in a direction away from the plurality of vapor passageways.

11. The loop heat pipe of claim 1 further comprises a bayonet tube completely surrounded by the secondary wick, wherein the envelope, the primary wick, the secondary wick, and the compensation chamber are composed of an identical material, the material is the group consisting of nickel, stainless steel, or titanium.

12. The loop heat pipe of claim 1, wherein the plurality of vapor passageways have a length to diameter ratio of greater than 3:1.

13. The loop heat pipe of claim 5 further comprises a nonporous tube surrounded by the secondary wick and extending past the secondary wick and into the compensation chamber, wherein the nonporous tube is centrally positioned in the loop heat pipe, the nonporous tube is part of the bayonet tube.

14. The loop heat pipe of claim 13, wherein the secondary wick comprises a plurality of vapor passageways near the nonporous tube.

15. The loop heat pipe of claim 1 further comprises a nonporous structure sealingly secured between the envelope and a compensation chamber, wherein fluid leakage is prevented between the plurality of vapor passageways at a first pressure, and the compensation chamber at a second pressure, the first pressure being greater than the second pressure.

16. The loop heat pipe of claim 1, wherein a cross sectional area of each vapor passageway of the plurality of vapor passageways increases based on a distance from a vapor line.

17. The loop heat pipe of claim 16, wherein the plurality of vapor passageways bifurcate near the vapor line.

18. The loop heat pipe of claim 1, wherein the primary wick, the envelope, and the compensation chamber are of one-piece construction.

19. The loop heat pipe of claim 18, wherein the compensation chamber further comprises a porous layer located on an interior surface.

20. The loop heat pipe of claim 18, wherein the compensation chamber incorporates a geometry subtending an angle ranging between about 5 degrees and about 90 degrees.

21. The loop heat pipe of claim 18, wherein the compensation chamber has a one-piece support structure.

22. The loop heat pipe of claim 19, wherein a plurality of wicks extend between the porous layer and the secondary wick.

23. The loop heat pipe of claim 1, wherein the primary wick and the envelope are fabricated with different materials.

24. The loop heat pipe of claim 1, wherein the primary wick, the envelope, and the secondary wick are of one-piece construction.

25. A loop heat pipe, comprising:

a porous primary wick;

a secondary wick surrounded by the primary wick;

a compensation chamber, wherein the secondary wick connects the primary wick and the compensation chamber, and the secondary wick extends past the primary wick into the compensation chamber; and a nonporous envelope unseparatingly partially surrounding the primary wick, wherein the primary wick includes a plurality of vapor passageways formed internally therein, wherein the plurality of vapor passageways is positioned along a periphery at least 0.005 inch away from the envelope, wherein the primary wick and the envelope are of one-piece construction, and wherein a loop heat pipe evaporator has a non-circular cross section.

26. The loop heat pipe of claim 25, wherein the cross section is generally rectangular.

27. The loop heat pipe of claim 25, wherein the compensation chamber has a one-piece support structure.

* * * * *